United States Patent [19]

Brogden

[11] Patent Number: 5,070,656

[45] Date of Patent: Dec. 10, 1991

[54] GRINDING MACHINE

[76] Inventor: Thomas H. N. Brogden, Homecroft 219, Blakelow Road, Macclesfield, Cheshire SK11 7EF, United Kingdom

[21] Appl. No.: 389,075

[22] Filed: Aug. 2, 1989

[30] Foreign Application Priority Data

Aug. 3, 1988 [GB] United Kingdom ..... 8818478

[51] Int. Cl.[5] ..... B24B 7/18

[52] U.S. Cl. ..... 51/177; 15/49.1; 299/39

[58] Field of Search ..... 51/174, 177, 170 R, 51/170 T; 15/87, 98; 299/39, 40, 41

[56] References Cited

U.S. PATENT DOCUMENTS

| | | | |
|---|---|---|---|
| 487,198 | 11/1892 | McCutchan | 51/177 |
| 3,347,596 | 10/1967 | Brejcha | 51/177 |
| 3,452,486 | 7/1969 | Lombardo et al. | 51/177 |
| 3,732,590 | 5/1973 | Horst | 15/49.1 |
| 4,273,384 | 6/1981 | Freeburn | 51/177 |
| 4,727,686 | 3/1988 | Persson | 51/177 |

FOREIGN PATENT DOCUMENTS

| | | | |
|---|---|---|---|
| 310736 | 5/1929 | United Kingdom | 51/177 |

*Primary Examiner*—Roscoe V. Parker

*Attorney, Agent, or Firm*—Townsend and Townsend

[57] ABSTRACT

A grinding machine is provided which has a plurality of grinding heads (42) upon which the weight of the machine rests to urge the grinding heads into engagement with the surface there beneath, each head (42) being composed of a plurality of individual grinding stones (44) and each grinding stone (44) being connected to a body of its head by a resilient mounting, the stones in each head being arranged and constructed so that the area of operation of each head overlaps with any neighbor in order that an entire surface can be ground.

19 Claims, 9 Drawing Sheets

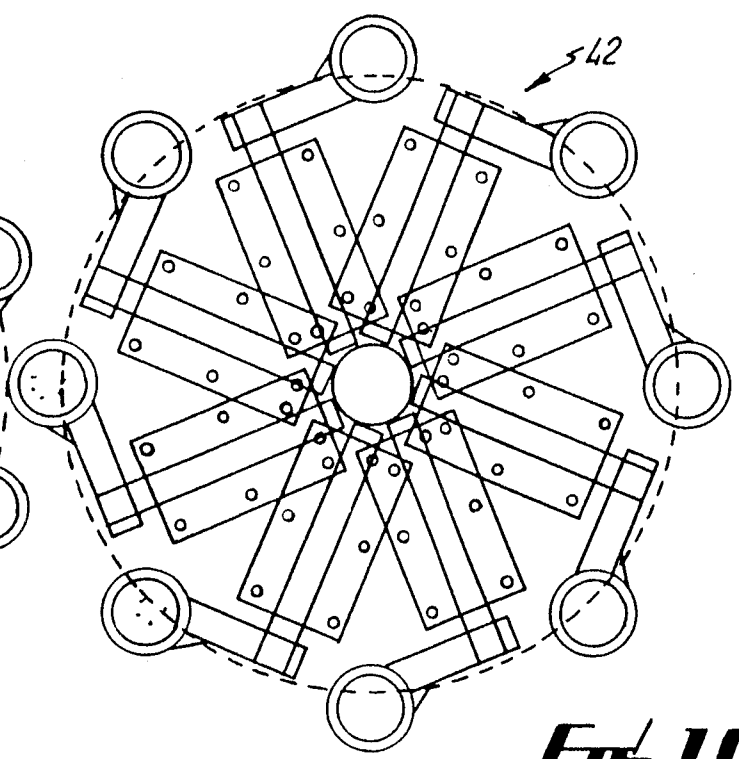
FIG. 10a
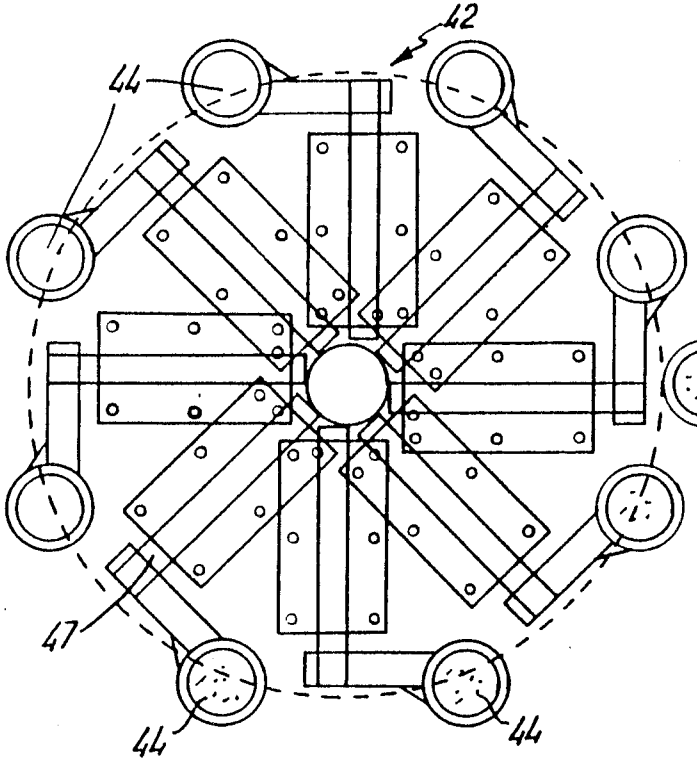
FIG. 10b
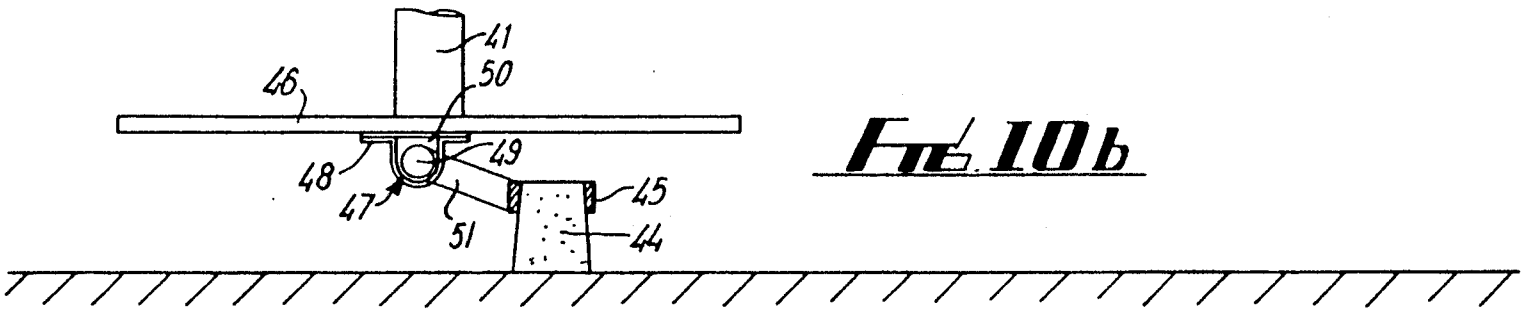

GRINDING MACHINE

This invention relates to a machine for grinding floors, for example floors made from terrazzo, concrete and comparable hard materials which, after laying need to be ground to produce a suitable bearing surface.

Conventionally, machines are used which include a number of spindles each mounting a rotatable head which in turn carries three abrasive stones spaced around the axis of the head. The head is connected to its drive shaft by means of a flexible bearing which ensures that when the machine is brought into contact with the floor all three stones bear equally on the floor under the weight of the head. A typical machine includes four contra rotating heads (to reduce torque) and the stones on the various heads interdigitate during their synchronised rotation to ensure that any particular portion of the floor is covered by several stones moving in different directions.

This existing stone and drive configuration has been found to achieve an optimum cutting rate using silicon carbide abrasive and because of their relatively small size the stones have a self cleaning action and do not clog.

However, despite these advantages of the head itself the machine in general has several disadvantages. Firstly, all such machines have, heretofore, been adapted to be manually operated, that is to say an operator must push the machine along the floor by hand. As the machine is rather heavy this is not an easy job. As a further point, the rotating action of the machine tends to transmit a lot of vibration to the frame of the machine and the operator becomes rapidly fatigued. Additionally, because the machines moves relatively slowly across the floor an operator very easily becomes bored with simply walking at an extremely slow pace across a large area of floor. This can lead to inattention and possibly poor floor finishing. A further disadvantage of the known machine is that as the machine is a floor mounted and manually operated wheeled machine (despite being quite a heavy machine) it is rather difficult to raise the machine in order to replace the stones when this is necessary. Further, the rate of production of the machine is rather slow especially when very large areas need to be ground.

An object of the present invention is to provide an improved machine wherein some or all of the above described disadvantages are eliminated or reduced.

The invention provides, as a first feature, a floor grinding machine including a plurality of contra-rotating heads with interdigitating stones, characterising that each head has at least six stones radially spaced around its perimeter and each stone is spring-loaded towards a floor with a degree of independence.

Conveniently, there are an even number of heads, with half the heads rotating in each direction. Normally it is expected that there will be four heads, but six heads is a possibility.

Preferably there are eight stones mounted on eight arms on each head. Each head can include a shaft which is connected rigidly to a gear box for driving in unison by an appropriate drive, such as an arrangement of belts and pulleys.

Each stone can be mounted in a holder which is itself connected to the relevant shaft in a spring loaded manner. In one possible embodiment the arm is itself a leaf spring which serves both the purpose of the arm and the spring and biasses the stones towards the floor. In a further embodiment there is a separate arm pivotally attached to the shaft with a spring urging the arm and its associated stone towards the floor. Preferably the spring force and arrangement is such that the load on the stone is constant throughout its likely operating range, that is to say between the condition wherein a stone is new and relatively thick and its finally worn out condition where its height (considered in relation to its holder) is approaching zero. The whole or most of the weight of the grinding machine rests, through the springs, on to the stone. The spring stiffness is arranged so that the unevenness of the floor is accommodated and all of the stones are in contact with the floor at all times when grinding is taking place. If the springs are too stiff those stones with the greatest force on them will tend to leave scratches on the floor and if the springs are too flexible there will be insufficient tendency to grind the highest parts of the floor more than other parts and the required tendency to grind unevenness out of the floor is reduced.

The stones can be of conventional form similar to those used in existing machines, being of silicon carbide. The size of the stones can be between 2" and 3" diameter (50 to 75 mm) and the force urging each stone downwards can be from 65 to 140 lbf (30 to 65 kg) per stone, preferably about 100 lbf (45 Kg) per stone. The diameters of the heads and the velocity of the shafts are preferably chosen so that the linear speed of the stones across the floor is 2100 feet per minute (640 meters per minute).

These speeds and loadings and stone size have been chosen to match existing parameters in this respect. It is known that these parameters of existing machines (in relation to the particular abrasive concerned) are optimum for good cutting and efficient operation.

It will be appreciated, of course, that in relation to other abrasives and different sized stones, different loadings and linear speeds may be appropriate.

The invention provides, as a second feature of the invention, a floor grinding machine including a grinding assembly having a plurality of heads driven rotatably, via a gear box, from an internal combustion engine, the machine being adapted to be, in operation, supported on the floor by its grinding heads but attached to and controlled from a fork lift truck.

As the machine is often likely to be used within a relatively enclosed area not subject to external ventilation, it is preferable if the internal combustion engine is a low pollution engine such as an engine operating from L.P.G and incorporating a catalytic converter.

As minimum pollution is generated by any internal combustion engine (and particularly an L.P.G. internal combustion engine) when it is operating at a standard load, the arrangement of the invention is particularly advantageous in that the grinding pressure and therefore the grinding energy seldom changes in use, all the variable propulsion force being provided by the fork lift truck.

The fork lift truck can be itself driven by means of a low pollution internal combustion engine, but is preferably electrical. In a particularly advantageous development (particularly useful where the machine is to be used in a partly finished building where a suitable source of electric power and charger are not likely to be available) the floor grinding machine includes a generator and electrical output which can be connected to the fork lift truck to supply a recharging current to the fork lift truck batteries whilst it is in operation. Such a modification of the engine of the machine does not lead to any increased pollution because its power can simply be set at a value which is higher than that needed to operate the polishing heads, the excess power being used to drive a conventional generator producing a constant output of electrical power. In any event the amount of power required to propel the truck is very much less than that required for grinding. In these circumstances there is little or no cyclic load on the internal combustion engine which can lead to increased emissions of noxious exhaust products.

The fork lift truck can serve to raise the machine in a very simple way when the machine needs to be raised for servicing, particularly for changing the stones.

Preferably, the machine is adapted to be connected directly to the vertically movable frame of the fork lift truck rather than to be supported by the forks.

The machine of the invention can, using only a slightly larger grinding assembly, operate at speeds of over three times the speed of known machines. Further, the operator is in a relaxed and protected environment not subjected to vibration and spaced away from the dust and/or dirt produced during the grinding operation.

In use on a site the fork lift truck can readily have its forks re-attached and be used for other purposes such as the unloading of palleted tiles from supply vehicles.

It has been contemplated that it would be possible to incorporate a purpose made chassis/drive vehicle to carry the grinding machine of the invention. However, as it is not expected that the volume production of such machines would be significant, the use of a separate fork lift truck to load and unload a machine and supply the propulsive power is economically much more attractive.

The invention will be described further, by way of example, with reference to the accompanying drawings wherein.

Figure 4A:
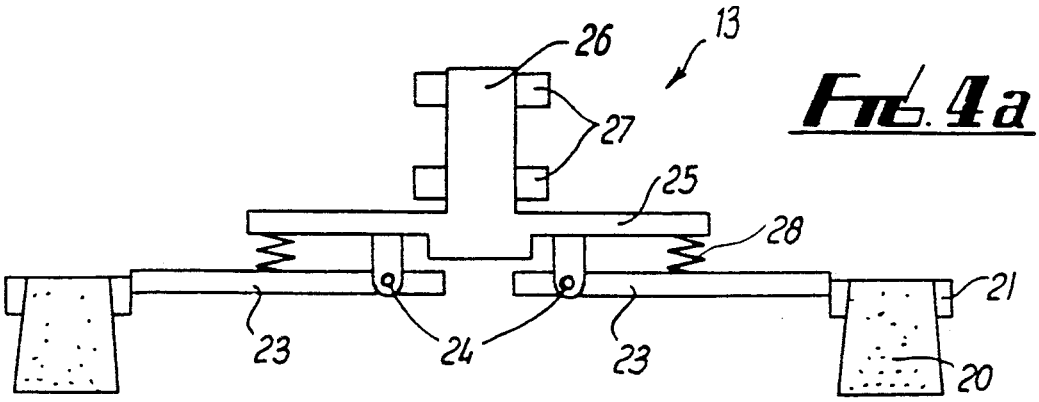
Figure 4B:
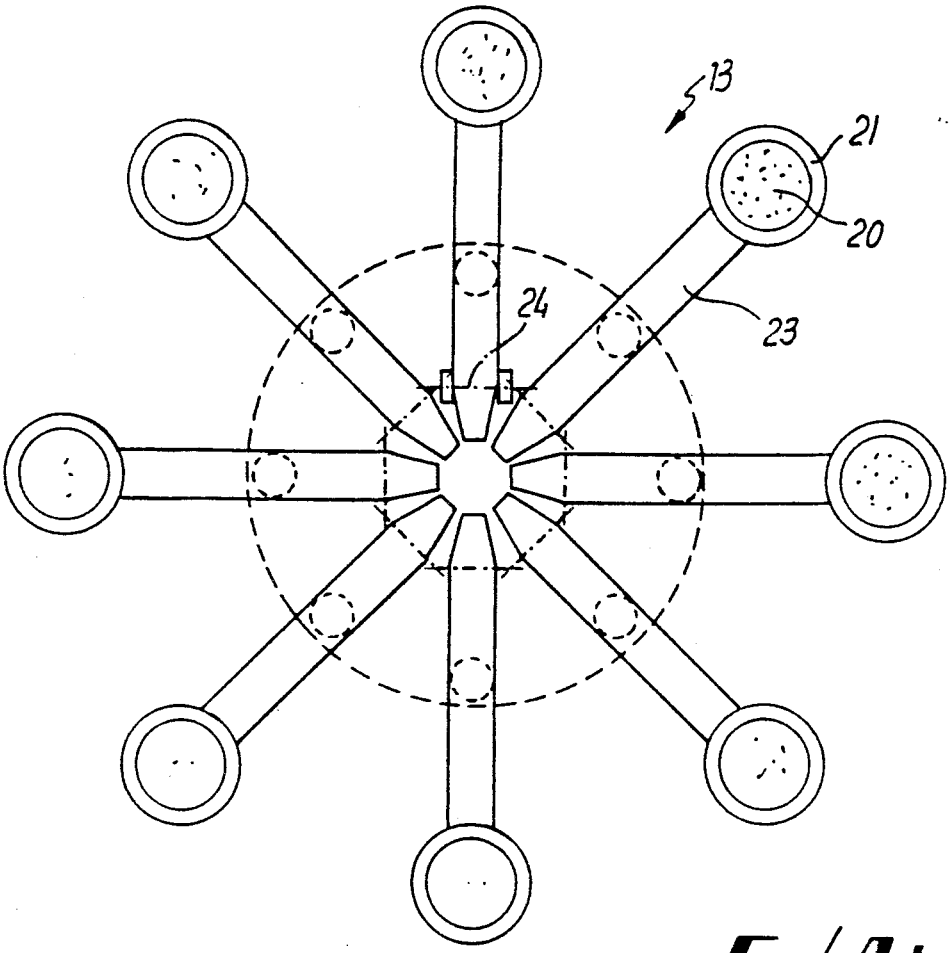
Figure 5A:
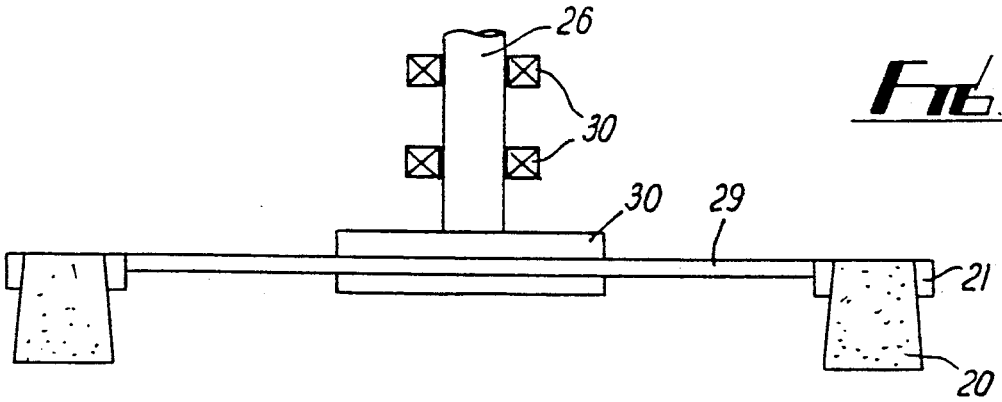
Figure 5B:
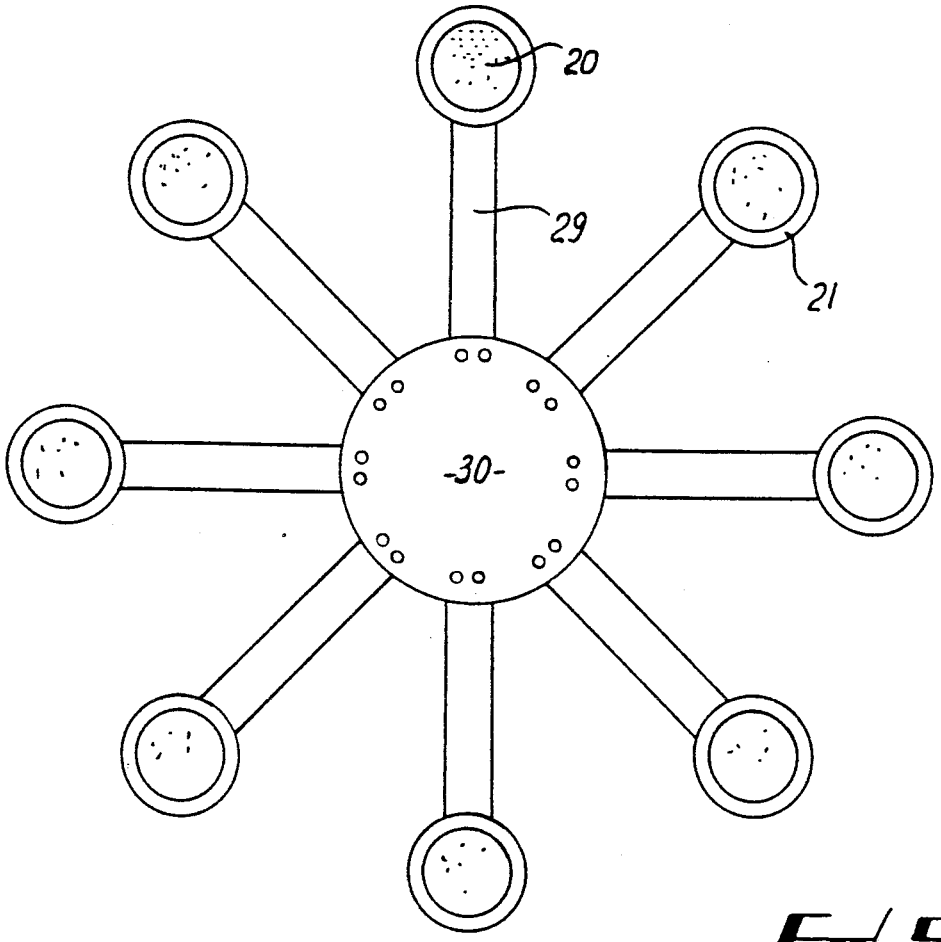
Figure 6A:
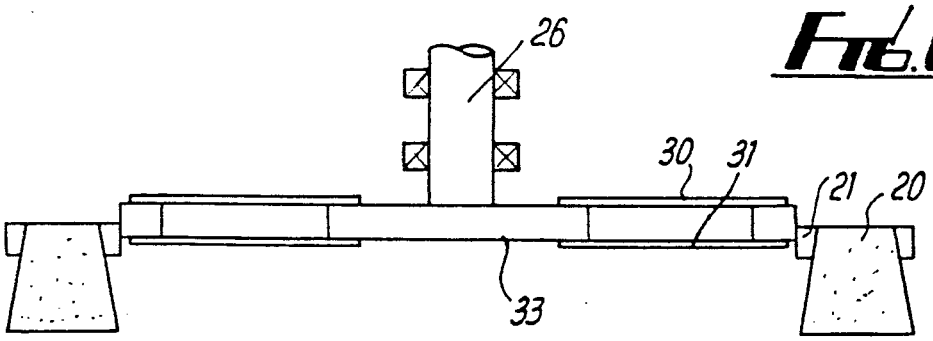
Figure 6B:
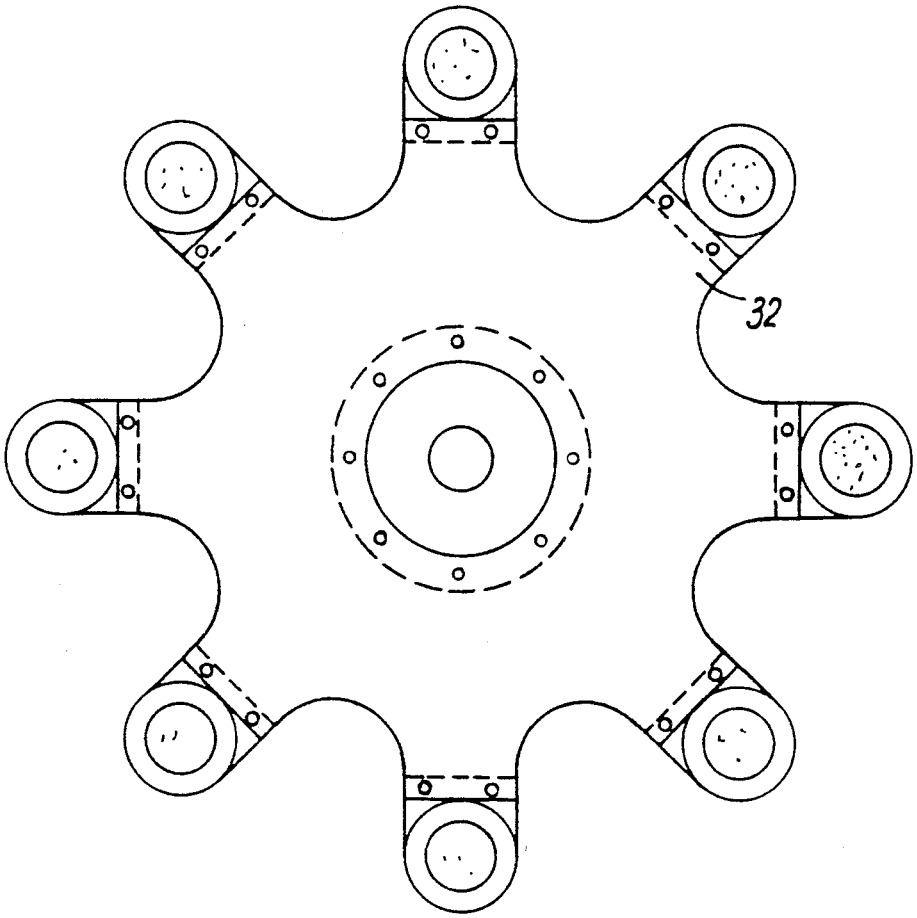

FIGS. 4*a* and 4*b* are sketches illustrating one possible manner of spring loading the stones of the head;

FIGS. 5*a* and 5*b* illustrate the second possible way of spring loading the stones;

FIGS. 6*a* and 6*b* illustrate a further possibility.

Figure 8:
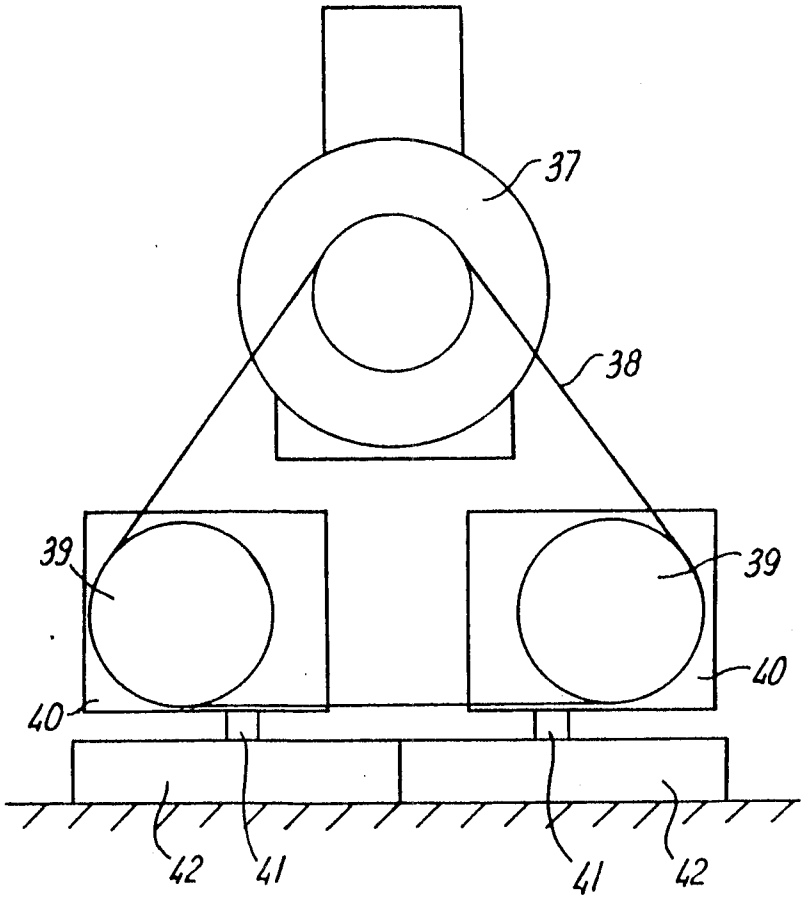
Figure 7:
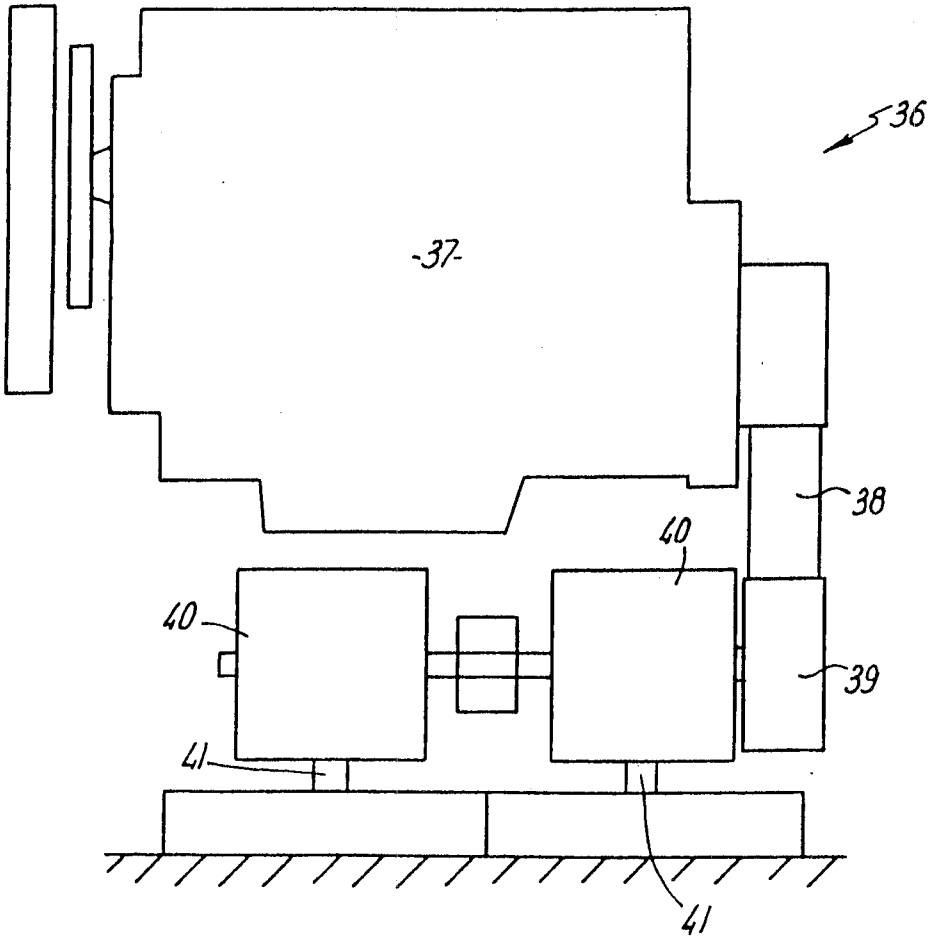
Figure 9:
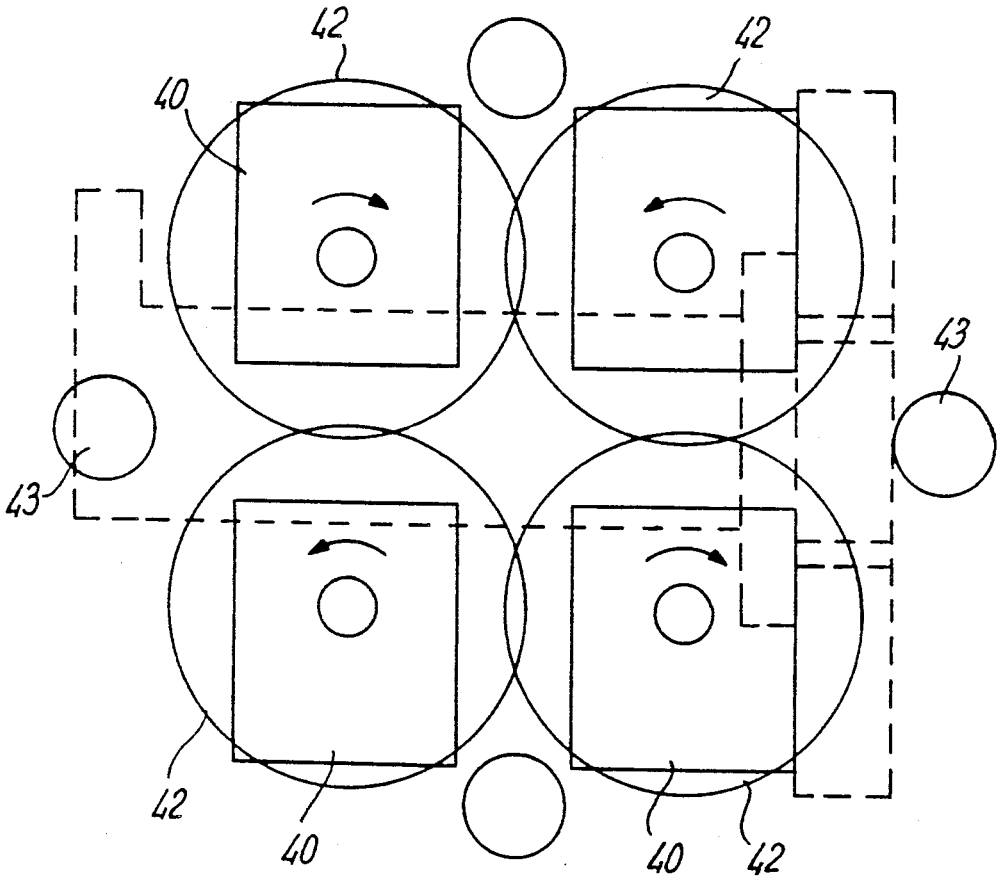

FIG. 7 is a schematic illustration of a further preferred configuration of the working portions of the machine in side view;

FIG. 8 is a comparable view showing an end view of the configuration;

FIG. 9 is a plan view of the configuration; and

FIG. 10*a* is an underneath plan view illustrating two grinding heads.

FIG. 10*b* is a sketch illustrating the torsion shaft mounting of a grinding head shown in FIG. 10.

Figure 1:
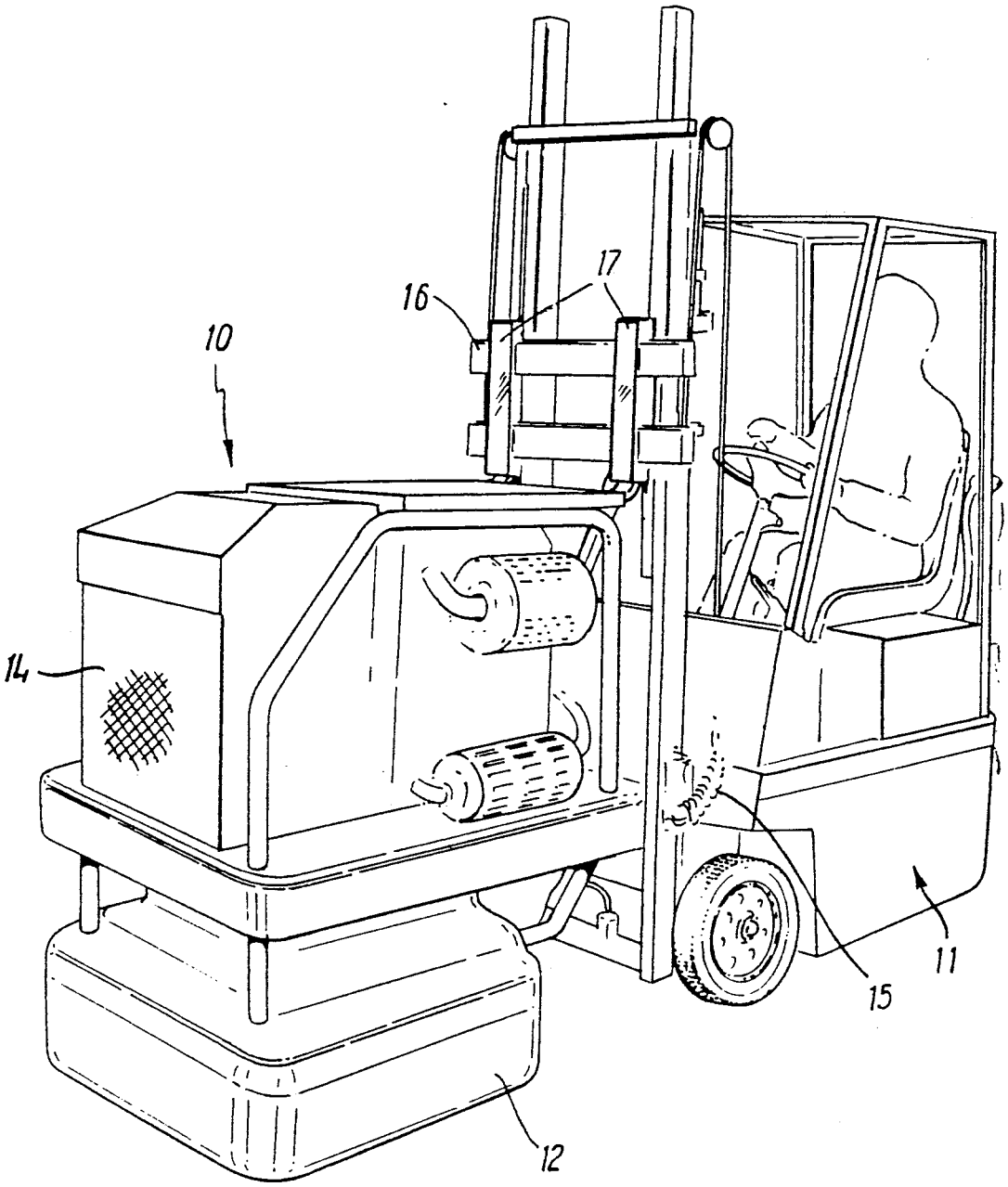
FIG. 1 is a front perspective view of a preferred machine of the invention mounted on a fork lift truck.

Referring firstly to FIG. 1, a preferred embodiment of floor grinding machine 10 of the invention is adapted for use with a fork lift truck 11 whose forks have been removed. The machine 10 includes a grinding assembly 12 within which are four contra-rotating grinding heads 13 (see FIG. 2). The grinding assembly 12 houses the heads 13 and appropriate gearing (see FIG. 3).

Above the grinding assembly 12 is a motor housing 14 which mounts an L.P.G. gas burning internal combustion engine and its appropriate cylinders together with (for much reduced pollution) a catalytic exhaust converter. Also within the housing 14 (not shown) is an electrical generator connected to be driven by the internal combustion engine and to produce electrical power transmittable via a output lead 15 to charge batteries (again not shown) of the truck 11.

The housing 14 and the assembly 12 are structurally united and are supported on a vertically movable frame 16 of the truck 11 by means of hooks 17.

In use the entire weight of the housing 14 and its contents and of the grinding assembly 12 will be supported by the four grinding heads which rest on the floor. The fork lift truck 11 will only provide the horizontal movement and steering capacity for the machine. This ensures that in use there is a constant weight on the grinding heads which ensures maximum grinding efficiency whilst maintaining the same criteria of stone size, loading per stone and stone velocity, such conditions being the same as those which have been found satisfactory in the past. The stones used are circular in plan, although any other shape is possible, always bearing in mind that sharp corners do tend to chip when in use and therefore are not preferred. The diameter of the stones can be from 50 to 70 mm preferably about 57 to 60 mm. The loading per stone is between 30 and 65 kg typically about 45 kg. The linear velocity of each stone is about 2100 feet per minute (640 meters per minute). The various speeds can be larger than this if features to help the removal of debris are incorporated.

Figure 2:
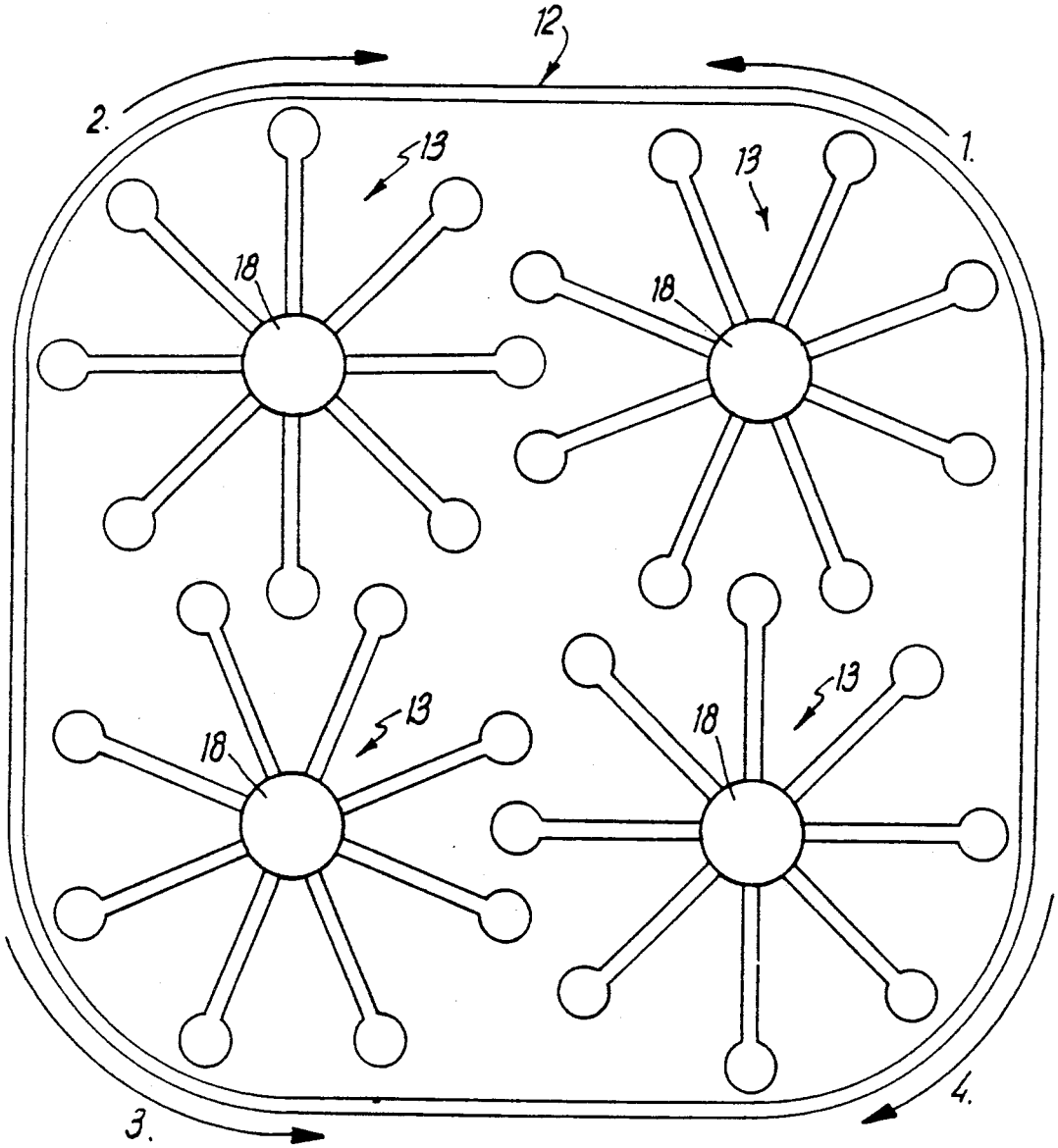
FIG. 2 is an underneath schematic plan view showing a grinding assembly of the machine of the invention.
Figure 3:
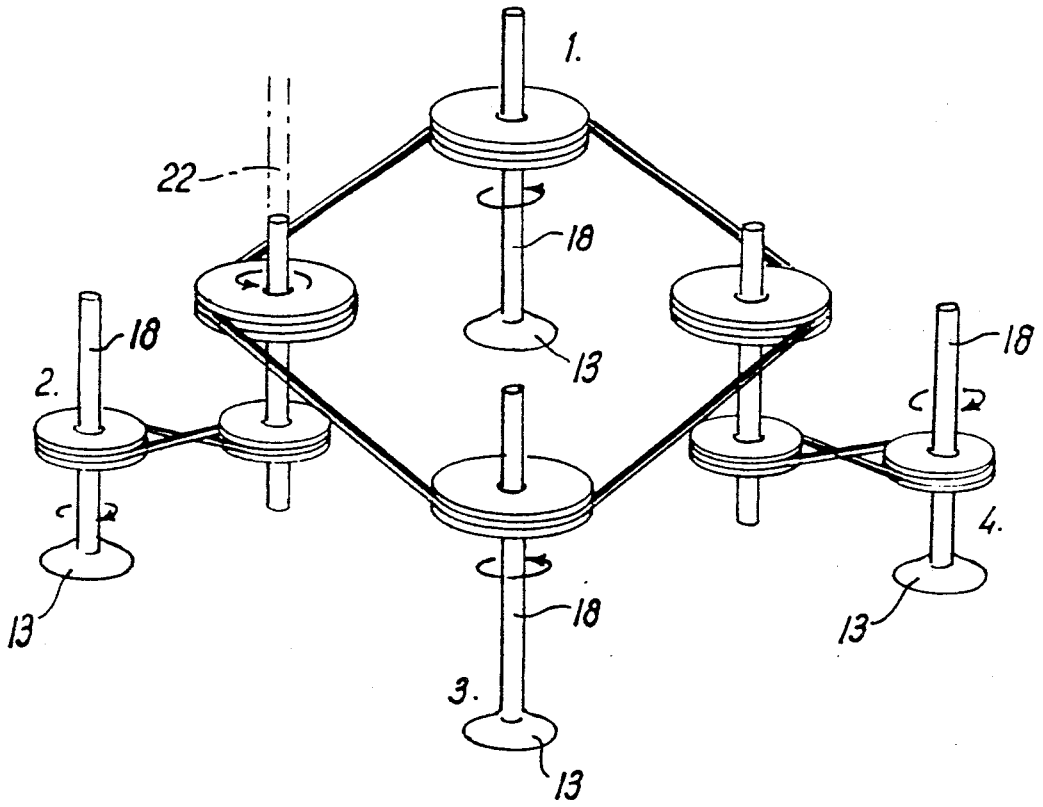
FIG. 3 is a sketch illustrating one possible gear box/-drive for the heads.

Referring now to FIG. 2 it will be seen that an underneath plan view of the assembly 12 reveals four grinding heads 13 which are at the ends of shaft 18 each head 13 includes eight radial arms 19 each of which carries a stone 20 in its carrier 21. In FIGS. 2 and 3 the grinding heads 13 are designated numbers 1, 2, 3 and 4 and rotate in synchronism at the same speed in the directions indicated by the arrow. It will be appreciated that the stones on each head interdigitate with the stones on two adjacent heads during rotation.

FIG. 3 shows a possible belt gearing arrangement which can drive the shafts 18 in the appropriate directions. As there are many such possible gearing arrangements the arrangement of FIG. 3 will not be described in detail. However, an input drive can come via a shaft 22.

It will be noted, however, that the shaft 18 are fixed relative to the assembly 12 and do not incorporate flexible couplings as has been necessary with the previously known machines. This allows the shafts 18 to be simple in construction and strongly mounted in simple bearings. This feature also eliminates a degree of vibration.

FIG. 4*a* illustrates a third possible embodiment of grinding head 13 which has stones 20 in carriers 21. Carriers 21 are mounted on the end of arms 23 pivoted at 24 on brackets depending from a disc 25 on the end of a shaft 26 mounted in simple bearings 27. Each arm 23 is urged downwardly by a compression spring 28. It will be appreciated that the entire weight of the machine is borne by the stones generally equally and each stone is individually urged into contact with the floor.

FIGS. 5*a* and 5*b* illustrate a comparable arrangement except that the pivot arms 23 and springs 28 have been eliminated and the stone holder 21 are simply supported on the ends the spring arms 29 extending outwardly from a mounting body 30 on the lower end of shaft 26.

FIGS. 6*a* and 6*b* illustrate a further possible embodiment comparable to embodiments of FIGS. 5*a* and 5*b* but wherein the spring arms 29 are replaced by a pair of generally parallel spring plates 30.31. The shape of the spring plates will be evident from FIG. 6*b* and it will be seen that they are essentially annular having outwardly extending "teeth" 32 which are attached to the stone holders 21. The inner periphery of the annular plates 30, 31 are secured to a body 33 at the lower end of shaft 26. This arrangement has particular advantages in that the mounting of the two plates 30,31 tends to create a type of parallelogram linkage between the stone and the body 33. Thus, during flexible of plates 30 and 31 below a face of the stone tends to remain parallel to the floor. In addition, the annular shape of the springs 30,31 is particularly good at transferring tangential forces from the shaft to the stone. Whereas in the embodiment of FIGS. 4 and 5 the drag caused by the stones engagement with the floor is transmitted through a long slender beam where it creates quite a considerable torque on the body. In the embodiment of FIG. 6 the generally annular continuous nature of the two plates 30, 31 makes for a much more balanced force transfer and a much greater tangential rigidity.

In FIGS. 5 and 6 the arms 29 or the plates 30,31 can be made of any convenient material to give the desired rigidity, for example, spring metal, or plastic reinforced composite materials such as glass reinforced plastics material. A glass reinforced plastics material supplied in the U.K. by the 3M Corporation and sold under the trade name 'SCOTCH PLY' is particularly suitable.

The machine of the invention, when in use, has the various shafts 18 driven by its internal combustion engine and the entire weight of the machine is supported on the stone. The fork lift trucks provide motive and steering power. If desired the grinding process can be wet and in such conditions a reservoir for water and a supply of water to the stones, or the area to be worked can be provided for in conventional manner.

The machine of the invention is only slightly increased in size compared to existing machines, but because it has a larger number of stones it can operate substantially faster, that is to say it can grind floor area at a significant greater rate that existing machines. The combination of the greater size and greater number of stones gives a factor of between three and four times faster than the existing machine. In addition, of course, the driver is separated from the vibration and dirt of the process and can safely sit in the cab of the fork lift truck guiding the operation.

Referring now to FIG. 7, it will be seen that the machine of the invention has an engine 37 whose output drives a toothed belt 38 which engages a pulley 39 on a shaft which drives two of four gearboxes 40. The arrangement of the drive (see FIGS. 8 and 9) is such that all the gearboxes 40 are driven in unison. Each gearbox has a depending shaft 41 which carries a grinding head 42. As illustrated in FIG. 9, the four heads 42 are contra-rotating in such a manner that there is no net directional force tending to move the machine over a surface. It will also be seen from FIGS. 9 and 10 that the individual heads 42 overlap so that as the machine moves over a surface the entire surface is ground.

FIG. 9 also illustrates a particularly important feature regarding adjustment of the machine. It will be seen that there are provided four pneumatic rams 43 which are only illustrated schematically. The rams 43 carries castors (not shown) which can be lowered into contact with the floor surface and urged in such a way as to tend to lift the four grinding heads up from the surface. The rams are arranged symmetrically in relation to the weight of the grinding heads and associated drive. Thus, when the same air pressure is applied to the rams 43 they exert an upward pressure on the assembly comprising the four grinding heads 42. This enables the grinding pressure to be reduced which is advantageous in some circumstances. Further, the existence of the castor bearing rams 43 enables the heads to be raised for maintenance and replacement of grinding stones.

As shown in FIGS. 10*a*, and 10*b* each grinding head includes eight stones, each grinding head 42 includes eight grinding stones 44 each mounted in an enclosing holder 45.

Each head 42 has a base plate 46 which is mounted on its respective shaft 41. Arranged radially around the base plate 46 are eight radially extending bearing assemblies 47 each of which consists of a housing 48 inside which is arranged a torsion shaft 49. The space between the torsion shaft 49 (which can be circular or non-circular) is filled with a resilient material and thus any torsion applied to the shaft 49 is resisted by the material 50. Each torsion shaft 49 bears at its end a trailing arm 51 which is attached to the holder 45. When the machine is resting on its grinding heads each stone 44 is loaded by a portion of the weight of the machine acting via its respective torsion shaft 49 and trailing arm 51. The requisite grinding pressure is arranged to be commensurate with the type of stone, the type of surface to be used and the rate of removal required.

FIG. 10*a* also illustrates how two adjacent grinding heads 42 overlap. This is arranged by the respective angular relationship being chosen so that each grinding stone on each head interdigitates between a pair of corresponding grinding stones on the other head to ensure full coverage.

What is claimed is:

1. A floor grinding machine comprising a plurality of contra-rotating heads with interdigitating stones, each head having at least six stones radially spaced around its perimeter, an arm capable of vertical movement individually mounting each stone and means for individually downwardly spring loading each arm and therewith the associated stone.

2. A floor grinding machine as set forth in claim 1, wherein there are an even number of said heads, with half said heads rotating in each direction.

3. A floor grinding machine as set forth in claim 2, wherein there are four or six heads.

4. A floor grinding machine as set forth in claim 1 wherein there are eight stones mounted on eight arms on each head.

5. A floor grinding machine as set forth in claim 1 wherein each head includes a shaft and each shaft is connected to a gear box for driving in unison.

6. A floor grinding machine as set forth in claim 5, wherein drive is by an arrangement of belts and pulleys.

7. A floor grinding machine as set forth in claim 5 wherein each stone of each head is mounted in a holder which is itself connected to each shaft.

8. A floor grinding machine as set forth in claim 1 wherein said arm is a leaf spring which serves to spring load said stone downwards.

9. A floor grinding machine as set forth in claim 1 wherein each head includes a shaft connected to a gear box and said arms are pivotally attached to said shaft and spring biased to urge said stones downwards.

10. A floor grinding machine as set forth in claim 1 wherein each said arm is connected to a shaft of said head by a torsion bar which urges said stone downwards.

11. A floor grinding machine as set forth in claim 10 wherein each arm is a trailing arm which carries a holder of said stone.

12. A floor grinding machine as set forth in claim 1 wherein the grinding head is supported by a plurality of support structures arranged around its periphery and selectively movable towards and away from a surface there beneath.

13. A floor grinding machine as set forth in claim 12 wherein the supports are fluid cylinders.

14. A floor grinding machine as set forth in claim 13 wherein the cylinders carry castors.

15. A floor grinding machine as set forth in claim 13 wherein the cylinders are equally spaced around the machine so that by applying equal pressure to each a unified regular force can be applied to raise the head.

16. A floor grinding machine as set forth in claim 7 wherein the spring force and arrangement is such that a load on the stone is constant.

17. A floor grinding machine as set forth in claim 16 wherein the spring stiffness is arranged so that unevenness of the floor is accommodated and all of the stones are in contact with the floor at all times when grinding is taking place.

18. A floor grinding machine as set forth in claim 1 wherein the size of the stones is between 2" and 3" diameter and the force urging each stone downwards is from 65 to 140 lbf per stone, preferably about 100 lbf per stone.

19. A floor grinding machine as set forth in claim 8 wherein the diameters of the heads and the velocity of the shafts are chosen so that the linear speed of the stones across the floor is 2100 feet per minute.

* * * * *